US009650704B2

(12) United States Patent
Kochi et al.

(10) Patent No.: US 9,650,704 B2
(45) Date of Patent: May 16, 2017

(54) SEAMLESS STEEL PIPE FOR HOLLOW SPRING

(71) Applicants: KOBE STEEL, LTD., Kobe-shi (JP); SHINKO METAL PRODUCTS CO., LTD., Kitakyusyu-shi (JP)

(72) Inventors: Takuya Kochi, Hyogo (JP); Hitoshi Hatano, Hyogo (JP); Eiichi Tamura, Hyogo (JP); Kotaro Toyotake, Fukuoka (JP)

(73) Assignees: KABUSHIKI KAISHA KOBE SEIKO SHO (KOBE STEEL, LTD.), Kobe-shi (JP); SHINKO METAL PRODUCTS CO., LTD., Kitakyusyu-shi (JP)

( * ) Notice: Subject to any disclaimer, the term of this patent is extended or adjusted under 35 U.S.C. 154(b) by 344 days.

(21) Appl. No.: 14/407,106

(22) PCT Filed: Jun. 11, 2013

(86) PCT No.: PCT/JP2013/066086

§ 371 (c)(1),
(2) Date: Dec. 11, 2014

(87) PCT Pub. No.: WO2013/187409

PCT Pub. Date: Dec. 19, 2013

(65) Prior Publication Data

US 2015/0159245 A1 Jun. 11, 2015

(30) Foreign Application Priority Data

Jun. 11, 2012 (JP) ..... 2012-132104

(51) Int. Cl.

| | |
|---|---|
| ***C22C 38/02*** | (2006.01) |
| ***C22C 38/04*** | (2006.01) |
| ***C22C 38/18*** | (2006.01) |
| ***C22C 38/14*** | (2006.01) |
| ***C22C 38/12*** | (2006.01) |
| ***C22C 38/54*** | (2006.01) |
| ***C22C 38/00*** | (2006.01) |
| ***C22C 38/06*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/34*** | (2006.01) |
| ***C22C 38/42*** | (2006.01) |
| ***C22C 38/46*** | (2006.01) |
| ***C22C 38/50*** | (2006.01) |
| ***C21D 9/02*** | (2006.01) |
| ***C21D 9/08*** | (2006.01) |
| ***C22C 38/20*** | (2006.01) |
| ***C22C 38/22*** | (2006.01) |

(52) U.S. Cl.

CPC ..... *C22C 38/54* (2013.01); *C21D 9/02* (2013.01); *C21D 9/08* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/18* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *C22C 38/42* (2013.01); *C22C 38/46* (2013.01); *C22C 38/50* (2013.01); *C21D 2211/004* (2013.01); *C21D 2211/005* (2013.01); *C21D 2211/009* (2013.01); *Y10T 428/12292* (2015.01)

(58) Field of Classification Search

None

See application file for complete search history.

(56) References Cited

U.S. PATENT DOCUMENTS

| | | | |
|---|---|---|---|
| 5,904,787 | A | 5/1999 | Matsumoto et al. |
| 2007/0125456 | A1 | 6/2007 | Kochi et al. |
| 2012/0070682 | A1 | 3/2012 | Hatano et al. |
| 2012/0325364 | A1 | 12/2012 | Kochi et al. |

FOREIGN PATENT DOCUMENTS

| | | | |
|---|---|---|---|
| CN | 1974825 | | 6/2007 |
| CN | 2007-88478 | | 4/2008 |
| EP | 2 543 747 | A1 | 1/2013 |
| JP | 1-247532 | A | 10/1989 |
| JP | 2007-125588 | A | 5/2007 |
| JP | 2010-265523 | A | 11/2010 |
| JP | 2011-184704 | A | 9/2011 |
| JP | 2011-184705 | A | 9/2011 |
| WO | WO 2011/108675 | A1 | 9/2011 |

OTHER PUBLICATIONS

Extended European Search Report issued Apr. 12, 2016 in Patent Application No. 13804561.2.

(Continued)

*Primary Examiner* — Deborah Yee

(74) *Attorney, Agent, or Firm* — Oblon, McClelland, Maier & Neustadt, L.L.P.

(57) ABSTRACT

A seamless steel pipe for a hollow spring includes C: 0.2 to 0.7 mass %, Si: 0.5 to 3 mass %, Mn: 0.1 to 2 mass %, Cr: 3 mass % or less (excluding 0 mass %), Al: 0.1 mass % or less (excluding 0 mass %), P: 0.02 mass % or less (excluding 0 mass %), S: 0.02 mass % or less (excluding 0 mass %) and N: 0.02 mass % or less (excluding 0 mass %). A residual austenite content in an inner surface layer part of the steel pipe is 5 vol. % or less. An average grain size of a ferrite-pearlite structure in the inner surface layer part of the steel pipe is 18 μm or less. A number density of a carbide having a circle equivalent diameter of 500 nm or more and being present in the inner surface layer part of the steel pipe is $1.8\times10^{-2}$ particles/$\mu m^2$ or less.

9 Claims, No Drawings

(56) References Cited

OTHER PUBLICATIONS

International Search Report issued Aug. 27, 2013 in PCT/JP2013/066086 (with English language translation).
Written Opinion of the International Searching Authority issued Aug. 27, 2013 in PCT/JP2013/066086 (with English language translation).

SEAMLESS STEEL PIPE FOR HOLLOW SPRING

TECHNICAL FIELD

The present invention relates to a seamless steel pipe for a hollow spring to be used as valve springs, suspension springs or the like of internal combustion engines in automobiles or the like.

BACKGROUND ART

With a recent increasing demand for lightweight or higher output of automobiles for the purpose of a decrease in exhaust gas or improvement of fuel efficiency, high stress design has also been required for valve springs, clutch springs, suspension springs and the like which are used in engines, clutches, suspensions and the like. These springs tend to have higher strength and thinner diameter, and the load stress tends to further increase. In order to comply with such a tendency, a spring steel having higher performance in fatigue resistance and settling resistance has been strongly desired.

Further, in order to realize lightweight while maintaining fatigue resistance and settling resistance, hollow pipe-shaped steel materials having no welded part (that is to say, seamless pipes) have come to be used as materials of springs, instead of rod-shaped wire rods which have hitherto been used as materials of springs (that is to say, solid wire rods).

Techniques for producing the hollow seamless pipes as described above have also hitherto been variously proposed. For example, Patent Document 1 proposes a technique of performing piercing by using a Mannesmann piercer which should be said to be a representative of piercing rolling mills (Mannesmann piercing), then, performing mandrel mill rolling (draw rolling) under cold conditions, further, performing reheating under conditions of 820 to 940° C. and 10 to 30 minutes, and thereafter, performing finish rolling.

On the other hand, Patent Document 2 proposes a technique of performing hydrostatic extrusion under hot conditions to form a hollow seamless pipe, and thereafter, performing spheroidizing annealing, followed by performing extension (draw benching) by Pilger mill rolling, drawing or the like under cold conditions, resulting in the improvement of productivity and quality. Further, in this technique, it is also shown that annealing is finally performed at a predetermined temperature.

In the respective techniques as described above, when the Mannesmann piercing or the hot hydrostatic extrusion is performed, it is necessary to heat at 1,050° C. or more or to perform annealing before or after cold working, and there is a problem that decarburization is liable to occur in an inner peripheral surface and outer peripheral surface of the hollow seamless pipe during processing under hot conditions or working or in a subsequent heat treatment process. Further, at the time of cooling after the heat treatment, decarburization (ferrite decarburization) caused by the difference between the solute amount of carbon in ferrite and that in austenite also occurs in some cases.

Occurrence of the decarburization as mentioned above brings about a situation that surface layer parts of the outer peripheral surface and inner peripheral surface are not sufficiently hardened during quenching in the production of springs, which causes a problem that it becomes impossible to ensure sufficient fatigue strength in springs to be formed.

In addition, when there are flaws therein, the flaws become points on which stresses converge, and constitute a factor of early fractures thereof.

In addition, enhancement of fatigue strength in the case of general springs has generally been performed by applying residual stress to the outer surfaces of the springs by means of shot peening or the like. In the case of springs formed from a hollow seamless pipe, shot peening or the like cannot be given to the inner peripheral surfaces of the springs, and besides, traditional working methods are liable to bring about flaws in the inner peripheral surface. Thus, it is necessary to strictly control qualities with regard to decarburization, flaws and the like as compared with the case of solid materials.

As a technique for solving the above-described problems, a technique disclosed in Patent Document 3 is also proposed. In this technique, a rod material is hot-rolled, followed by piecing with a gun drill, and being subjected to cold working (draw benching or rolling), thereby producing a seamless steel pipe. Accordingly, heating can be avoided during piercing or extrusion.

CITATION LIST

Patent Documents

[Patent Document 1] JP-A-1-247532
[Patent Document 2] JP-A-2007-125588
[Patent Document 3] JP-A-2010-265523

SUMMARY OF INVENTION

Technical Problem

However, in the technique disclosed in Patent Document 3, annealing is performed at a relatively low temperature of 750° C. or less (regarding this point, the same as the technique disclosed in Patent Document 2). When the annealing is performed at such a low temperature, there is another problem in that the coarsening of carbides is likely to be accelerated.

Coarse carbides remain in an insoluble state during heating and quenching, which leads to a decrease in hardness and generation of a defective hardened structure and thus causes a decrease in fatigue strength (which may be referred to as "deterioration of durability"). In particular, recently, in a quenching process during spring production, short-time heat treatment using induction heating has been mainly performed from the viewpoint of reducing decarburization and regarding the size of facilities, and thus, carbides in an insoluble state are significantly likely to remain.

Further, recently, a higher level of fatigue strength than that of the conventional art is required, and the techniques which have hitherto been proposed cannot satisfy the required fatigue strength and are insufficient in durability.

The present invention has been made under such circumstances, and an object thereof is to provide a seamless steel pipe for hollow springs capable of allowing attainment of sufficient fatigue strength in the springs to be formed, through the control of metallographic structures in an inner surface layer part (a surface layer part of an inner peripheral surface) of a steel pipe (pipe).

Solution to the Problem

The present invention provides a seamless steel pipe for a hollow spring, which includes 0.2% to 0.7% (which represents "mass %"; hereinafter, the same shall be applied regarding the chemical component composition) of C, 0.5% to 3% of Si, 0.1% to 2% of Mn, 3% or less (not including 0%) of Cr, 0.1% or less (not including 0%) of Al, 0.02% or less (not including 0%) of P, 0.02% or less (not including 0%) of S, and 0.02% or less (not including 0%) of N, in which a residual austenite content in an inner surface layer part of the steel pipe is 5 vol. % or less, an average grain size of a ferrite-pearlite structure in the inner surface layer part of the steel pipe is 18 μm or less and a number density of a carbide which has a circle equivalent diameter of 500 nm or more and is present in the inner surface layer part of the steel pipe is $1.8\times10^{-2}$ particles/μm' or less. The term "circle equivalent diameter" described above refers to a diameter of a circle which is converted from the area of a carbide such that the area thereof is not changed when attention is paid to the size of the carbide.

For a steel material as raw materials of the seamless steel pipe for a hollow spring in the present invention, it is also beneficial to further include, as needed basis, (a) 0.015% or less (not including 0%) of B, (b) at least one kind selected from the group consisting of 1% or less (not including 0%) of V, 0.3% or less (not including 0%) of Ti, and 0.3% or less (not including 0%) of Nb, (c) 3% or less (not including 0%) of Ni and/or 3% or less (not including 0%) of Cu, (d) 2% or less (not including 0%) of Mo, (e) at least one kind selected from the group consisting of 0.005% or less (not including 0%) of Ca, 0.005% or less (not including 0%) of Mg, and 0.02% or less (not including 0%) of REM, (f) at least one kind selected from the group consisting of 0.1% or less (not including 0%) of Zr, 0.1% or less (not including 0%) of Ta, and 0.1% or less (not including 0%) of Hf, and the like. Depending on the kinds of elements included, properties of the seamless steel pipe for a hollow spring (or equivalently, the springs formed) are further improved.

Advantageous Effects of the Invention

As to the seamless steel pipe for a hollow spring in the present invention, not only the chemical composition of a steel material as raw materials is adjusted appropriately, but also various structures (residual austenite, an average grain size of a ferrite-pearlite structure, and coarse carbide) in an inner surface layer part of the steel pipe are controlled appropriately, and thus, it becomes possible to ensure sufficient fatigue strength in springs formed from the seamless steel pipe for a hollow spring.

EMBODIMENTS OF THE INVENTION

The present inventors have carried out studies from different angles on the control factors required for durability improvements with the aim of increasing fatigue strength. As factors dominating improvements in durability; decarburization depth, flaw depth and the like have so far been considered, and from these points of view, a wide variety of techniques have been suggested. However, there are limitations to what the hitherto suggested techniques can do under a high stress range, and there is a necessity to examine other factors as well for the purpose of achieving higher durability.

As a result, it has been turned out that various structures in an inner surface layer part (a surface layer part of the inner peripheral surface) of a steel pipe have considerable influences. More specifically, it has been found that fatigue strength can be remarkably improved by controlling formation of coarse carbides, an average grain size of a ferrite-pearlite structure and a residual austenite content.

To begin with, a description about the coarse carbide is explained. In traditional manufacturing methods, annealing was performed at a relatively low temperature being 750° C. or less (Patent Documents 2 and 3 described above). Performance of annealing at such a low temperature is accompanied by a problem that coarsening of the carbide present in an inner surface layer part of a steel pipe is liable to proceed. As a result of the study by the present inventors, it has been found that the coarse carbide remaining in an insoluble state during quenching constituted a factor inhibiting improvements in durability. And it has been found that the coarse carbide can be reduced by controlling annealing conditions appropriately, thereby further enhancing the durability. To be concrete, appropriate control of annealing conditions as mentioned hereafter has allowed the number density of a coarse carbide having a circle equivalent diameter of 500 nm or more to be reduced to $1.8\times10^{-2}$ particles/$\mu m^2$ or less, and as a result, durability improvement has been achieved. The number density of the coarse carbide is preferably $1.5\times10^{-2}$ particles/$\mu m^2$ or less, more preferably $1.2\times10^{-2}$ particles/$\mu m^2$ or less, still further preferably $1.0\times10^{-2}$ particles/$\mu m^2$ or less. The lower limit of the number density of the coarse carbide is 0. Further, the carbide of interest in the present invention is intended to include not only cementite ($Fe_3C$) present in a metallographic structure but also carbides of carbide-forming elements in steel material components (e.g. Mn, Cr, V, Ti, Nb, Mo, Zr, Ta or Hf).

The number density of carbide particles in an inner surface layer part of a steel pipe can be measured by the following method. For the purpose of observing an arbitrary traverse plane thereof (a cross section orthogonal to the axis of the pipe), an observation sample is prepared by carrying out cutting, embedding with a resin, mirror polishing, and then etching through the corrosion with picral. A surface layer part ranging from the outermost surface to a depth of 100 μm in the inner peripheral surface is observed by a scanning electron microscope (SEM) (magnification: 3,000 times). On a basis of SEM photographs (number of observation spots: 3), an area occupied by carbide is determined using an image analysis software (Image-Pro), and converted into a circle equivalent diameter. And the number density of a carbide having a circle equivalent diameter of 500 nm or more is measured, and the average thereof is calculated.

Next, descriptions about the average grain size (structure size) of the ferrite-pearlite structure and residual austenite are explained. As a result of the study by the present inventors, it has been found that the average grain size of the ferrite-pearlite structure and residual austenite content in an inner surface layer part of a steel pipe are factors influencing durability. As to traditional solid springs, shot peening treatment has been performed as a means for enhancing durability in their outer surfaces which would be starting points of fracture. However, in the case of a hollow spring, shot peening treatment cannot be given to an inner surface layer part of a steel pipe, and therefore, there was a problem that the inner surface of the steel pipe tends to become starting points of fracture. However, it has been found that, even if shot peening is not given to an inner surface layer part of a steel pipe, durability improvement thereof can be achieved by appropriately controlling metallographic structures in the inner surface layer part of the steel pipe. Details of its mechanism have not been clarified yet, but it has been found that, with respect to metallographic structures before quenching in the step of producing springs, the finer the average grain size of the ferrite-pearlite structure is, or the lower the residual austenite content is, as the structural condition, the higher durability of the springs after quenching could be achieved. Although detailed reasons thereof are uncertain, it is surmised that, by controlling the metallographic structures before quenching as mentioned above, the metallographic structures show a tendency to be refined after quenching, and concentration of local distortions under high stress is relieved when the metallographic structures after quenching have been refined, and thus, the durability thereof is enhanced.

The average grain size of the ferrite-pearlite structure as used in the present invention refers to an average grain size of a mixed structure of ferrite and pearlite. The average grain size can be determined by measuring grain size G measurements in accordance with a comparison method conforming to the method described in JIS G 0551 after carrying out etching with nital, and then converting the measured values into an average grain size d by the use of the following expression (1).

$$d=1/(\sqrt{8}\times 2^{G}) \quad (1)$$

Although JIS G 0551 describes the method of measuring grain sizes in a ferrite part alone, exclusive of a pearlite part, in the grain size measurements made on the ferrite-pearlite, grain sizes in ferrite and pearlite blocks (nojules) are measured all together in the present invention. In the measurements of pearlite blocks (nojules), grain units are determined by contrast after etching on the basis of descriptions in a paper by Takahashi, Nagumo & Asano, Nippon Kinzoku Gakkaishi (J. Japan Inst. Met. Mater.), 42(1978), 708.

More specifically, the average grain size of the ferrite-pearlite structure in an inner surface layer part of a steel pipe can be measured by the following method. For observation of an arbitrary traverse plane thereof (a cross section orthogonal to the axis of a pipe), an observation sample is prepared by carrying out cutting, embedding with a resin, mirror polishing, and then etching through the corrosion with nital. A surface layer part ranging from the inner surface to an inward position of 100 μm is observed by an optical microscope (magnification: 100 to 400 times), and then, grain sizes are determined by the comparison method, followed by converting into an average grain size based on the expression (1) (number of measurement spots: 4).

In the present invention, metallographic structures other than residual austenite include a ferrite-pearlite structure as a main constituent (the term "main" means that the structure of interest constitutes the highest proportion by volume of the whole metallographic structures), and may further include beinite and martensite in some cases. The present invention has no particular limitations to the proportions of metallographic structures except austenite. This is because durability improvement can be achieved by not only reducing residual austenite as a factor inhibiting improvements in durability, but also controlling the ferrite-pearlite structure so as to have a specified average grain size.

The finer the average grain size of the ferrite-pearlite structure is, the more the durability tens to be enhanced. Specifically, from the viewpoint of durability improvement, it is required that the ferrite-pearlite structure in the inner surface layer part of a steel pipe has an average grain size of 18 μm or less. The average grain size is preferably 15 μm or less, more preferably 10 μm or less, and still further preferably 5 μm or less. There is a tendency that the finer the average grain size of the ferrite-pearlite structure is, the more the durability tends to be enhanced. Hence the average grain size has no particular restriction as to its lower limit, but in actuality it is 1 nm or more.

On the other hand, it has been found that, because the residual austenite in the inner surface layer part of a steel pipe is a factor inhibiting improvement in durability, even when the average grain size of the ferrite-pearlite structure is made finer, it is difficult to achieve the improvement in durability so long as residual austenite is present in quantity. The residual austenite content in the inner surface layer part of a steel pipe is therefore controlled to 5 vol. % or less, preferably 3 vol. % or less, and still preferably 0.

The residual austenite content in the inner surface layer part of a steel pipe can be determined by the following method. For observation of an arbitrary traverse plane thereof (a cross section orthogonal to the axis of a pipe), an observation sample is prepared by carrying out cutting, embedding with a resin, wet polishing, and then electrolytic polishing finish. The residual austenite content (unit: vol. %) in this sample is determined by X-ray diffraction analysis.

From a steel material in which a chemical composition thereof has been appropriately adjusted (the appropriate chemical composition will be described below), the seamless steel pipe for a hollow spring can be produced according to the following procedure. With respect to each step in this production procedure, more concrete descriptions are given below.

[Hollowing Technique]

First, as a hollowing technique, an element steel pipe is prepared by hot extrusion, and then, it is subjected to cold working such as rolling or draw benching, soft annealing, and pickling treatment. These operations are repeated multiple times, and then, it is formed into a pipe having an intended size (outside diameter, inside diameter and length).

[Heating Temperature During Hot Extrusion: Less than 1,050° C.]

In the hot extrusion, it is recommended that the heating temperature is less than 1,050° C. When the heating temperature is 1,050° C. or more, the total decarburization becomes large. Thus, the heating temperature is preferably 1,020° C. or less, more preferably 1,000° C. or less. There is no particular restriction as to the lower limit of favorable heating temperature. However, when the heating temperature is too low, the extrusion is difficult to be performed. For this reason, the heating temperature is preferably 900° C. or more.

[Cooling Condition after Hot Extrusion: Controlling an Average Cooling Rate to be 1.5° C./Sec or More Until the Temperature Achieves 720° C. after Extrusion]

After hot extrusion is performed under the above-described conditions, cooling is performed at a relatively high cooling rate until the temperature achieves 720° C. As a result, decarburization during cooling can be reduced. In order to exhibit such an effect, the average cooling rate until the temperature achieves 720° C. is adjusted to 1.5° C./sec or more, and preferably 2° C./sec or more. There is no particular restriction as to the upper limit of the average cooling rate until the temperature achieves 720° C., but in terms of the production costs and the easiness of control, it is industrially preferred that the average cooling rate is 5° C./sec or less. In a temperature range below 720° C., the cooling has no particular restriction as to the rate thereof, and it may be carried out at a rate of about 0.1° C. to 3° C./sec.

[Cold Working Condition]

After carrying out the controlled cooling as mentioned above, cold working is performed. In the cold working, it is preferred that draw benching or cold rolling is performed repeatedly until the steel pipe having intended dimensions is produced. This is because, by performing the cold working and subsequent intermediate annealing several times, the average grain size or the like of a ferrite-pearlite structure is easily made fine such that the average grain size reaches the specified values.

[Annealing Step]

After production of the steel pipe having the intended dimensions through the cold working, annealing is further performed, and thus, not only the number density of a coarse carbide and the residual austenite content are reduced, but also the average grain size of a ferrite-pearlite structure is controlled. Further, the annealing allows reduction in hardness of the material.

There is no particular restriction as to the atmosphere in which the annealing is carried out, but when the atmosphere is a non-oxidizing atmosphere, such as an Ar atmosphere, nitrogen atmosphere or hydrogen atmosphere, decarburization which occurs during annealing can be reduced markedly. In addition, the annealing in such an atmosphere allows substantial reduction in thickness of produced scales, and it is therefore advantageous in that an immersion time during pickling carried out after annealing can be shortened and occurrence of deep pits caused by pickling can be prevented.

Further, it is preferable that the highest heating temperature during the annealing (annealing temperature) is adjusted to be 900° C. or more. In the traditional arts (Patent Documents 2 and 3), the annealing has been performed at relatively low temperatures of 750° C. or less. However, coarsening of carbide has progressed under annealing temperatures of 750° C. or less. In the present invention, attention has been focused on this fact, and the annealing is performed at such a high temperature (900° C. or more) so that carbide can be melted, not at the traditional low temperatures.

On the other hand, when the heating temperature is too high, the ferrite-pearlite structure is coarsened instead. From the viewpoint of preventing the ferrite-pearlite structure from being coarsened, it is preferred that the annealing temperature is 950° C. or less, more preferably 940° C. or less, still preferably 930° C. or less.

Further, for making the structure finer, it is also important that the heating (annealing) time is controlled according to the annealing temperature. The ferrite-pearlite structure is coarsened by heating at a high temperature for a long time. Thus, the staying time at a temperature range of 900° C. or more is controlled to less than 10 minutes, preferably 7 minutes or less, more preferably 4 minutes or less. On the other hand, when the heating time is too short, coarse carbide remains and the quality of the material becomes nonuniform. Therefore, it is required to secure a heating time such that at least the intended effect can be obtained. Specifically, by controlling the heating time to 5 seconds or more, preferably 10 seconds or more, still preferably 20 seconds or more, it becomes possible to reduce coarse carbide and to control the average grain size of a ferrite-pearlite structure.

[Cooling after Annealing]

After annealing in the foregoing temperature range, it is appropriate to perform cooling to a predetermined temperature range while controlling a cooling rate. This is because, when the annealing is carried out at a higher temperature (900° C. or more) as compared with traditional cases (750° C. or less), the staying time in a high temperature range is shortened because grain growth of austenite is fast in the high temperature range, thereby inhibiting the grain growth of austenite and retaining fineness of the structure.

Specifically, the average cooling rate in a temperature range of 900° C. to 750° C. (cooling rate 1) is adjusted to 0.5° C./sec or more, preferably 1° C./sec or more, still preferably 2° C./sec or more. Additionally, the faster average cooling rate is more effective for refining structures, and the average cooling rate has no particular restriction as to its upper limit. However, when easiness of control of the cooling rate, effects of cooling rate and the like are taken into consideration, it is industrially preferred that the cooling rate is 10° C./sec or less.

In a temperature range of 750° C. to 600° C., slow cooling is carried out at an average cooling rate (cooling rate 2) of less than 1° C./see, preferably less than 0.5° C./see. This is because, for the purpose of avoiding formation of residual austenite in such a temperature range, it is preferred that transformation have progressed to a sufficient degree under high temperatures. The average cooling rate is preferably 0.1° C./sec or more.

The cooling rates (cooling rate 1 and cooling rate 2) at the first stage (900° C. to 750° C.) and the second stage (750° C. to 600° C.) may be the same as or different from each other. It is preferred that the cooling rate at each stage is adjusted so as to produce desired effects. Further, cooling in a temperature range below 600° C. has no particular restrictions, and any of natural cooling in the air, slow cooling and rapid cooling may be chosen in consideration of production facilities, production conditions and the like.

As mentioned above, in the annealing step in the present invention, such a stepwise cooling is performed, that is, after heating to a temperature of 900° C. or more in a non-oxidizing atmosphere, the cooling from 900° C. to 750° C. is performed at an average cooling rate of 0.5° C./sec or more (cooling rate 1) and the cooling from 750° C. to 600° C. is performed at an average cooling rate of less than 1° C./sec (cooling rate 2), thereby allowing the production of a hollow seamless steel pipe satisfying the above-specified number density of the coarse carbide, average grain size of the ferrite-peralite structure and residual austenite content.

[Pickling Step]

After annealing is performed as described above, a scale is formed on a surface layer of the material to no small extent, which adversely affects a subsequent step such as rolling or draw benching. Therefore, pickling treatment is performed using sulfuric acid or hydrochloric acid. However, when the process time of pickling treatment is increased, large pits caused by pickling are formed and remain as flaws. From this point of view, it is advantageous to reduce the pickling time. Specifically, the pickling time is preferably within 30 minutes and more preferably within 20 minutes.

The foregoing cold working, annealing (cooling after annealing) and pickling may be performed multiple times under the foregoing conditions as the need arises in the present invention. Although the coarse carbide, ferrite-pearlite structure and residual austenite, after the final annealing, are specified in the present invention, promotion of structure refining and the like by intermediate annealing or the like makes it possible to achieve not only the acceleration of dissolution of carbide during the annealing at a later step but also reduction in the coarse carbide, refining of the ferrite-pearlite structure and reduction in the residual austenite content at a relatively low temperature in a relatively short time.

[Step of Polishing of Inner Surface Layer]

In the present invention, when high fatigue strength and the like are required, steps of polishing and grinding of the inner surface layer may be adopted as needed basis for the purpose of removing flaws and a decarburized layer in the inner surface layer. It is appropriate that the amount of inner surface layer polished and ground is 0.05 mm or more, preferably 0.1 mm or more, still preferably 0.15 mm or more. Further, a degreasing step, a coating treatment step and the like may be carried out as needed basis.

In the hollow seamless steel pipe in the present invention, it is also important that the chemical component composition of the steel material used as the material is properly adjusted. Reasons for limiting the ranges of chemical components will be described below.

(C: 0.2% to 0.7%)

C is an element necessary for securing high strength, and for that purpose, it is necessary that C is contained in an amount of 0.2% or more. The C content is preferably 0.30% or more, and more preferably 0.35% or more. However, when the C content becomes excessive, it becomes difficult to secure ductility. Accordingly, the C content is required to be 0.7% or less. The C content is preferably 0.65% or less, and more preferably 0.60% or less.

(Si: 0.5 to 3%)

Si is an element effective for improving settling resistance necessary for springs. In order to obtain settling resistance necessary for springs having a strength level intended in the present invention, the Si content is required to be 0.5% or more. The Si content is preferably 1.0% or more, and more preferably 1.5% or more. However, Si is also an element which accelerates decarburization. Accordingly, when Si is contained in an excessive amount, formation of decarburized layer on the surfaces of the steel material is accelerated. As a result, a peeling process for removing the decarburized layer becomes necessary, and thus, this is disadvantageous in terms of production cost. Accordingly, the upper limit of the Si content is limited to 3% in the present invention. The Si content is preferably 2.5% or less, and more preferably 2.2% or less.

(Mn: 0.1 to 2%)

Mn is utilized as a deoxidizing element, and is an advantageous element which forms MnS with S as a harmful element in the steel material to render it harmless. In order to effectively exhibit such an effect, it is necessary that Mn is contained in an amount of 0.1% or more. The Mn amount is preferably 0.15% or more, and more preferably 0.20% or more. However, when the Mn content becomes excessive, a segregation band is formed to cause the occurrence of variations in quality of the material. Accordingly, the upper limit of the Mn content is limited to 2% in the present invention. The Mn content is preferably 1.5% or less, and more preferably 1.0% or less.

(Cr: 3% or Less (not Including 0%))

From the viewpoint of improving cold workability, the smaller Cr content is preferred. However, Cr is an element effective for securing strength after tempering and for improving corrosion resistance, and is an element particularly important in suspension springs in which high-level corrosion resistance is required, Such an effect increases with an increase in the Cr content. In order to preferentially exhibit such an effect, it is preferred that Cr is contained in an amount of 0.2% or more, and more preferably 0.5% or more. However, when the Cr content becomes excessive, not only a supercooled structure is liable to occur, but also segregation to cementite occurs to reduce plastic deformability, which causes deterioration of cold workability. Further, when the Cr content becomes excessive, Cr carbides different from cementite are liable to be formed, resulting in an unbalance between strength and ductility. Accordingly, in the steel material used in the present invention, the Cr content is preferably suppressed to 3% or less. The Cr content is more preferably 2.0% or less, and further preferably 1.7% or less.

(Al: 0.1% or Less (not Including 0%))

Al is added mainly as a deoxidizing element. In addition, Al combines with N to form AlN, thereby rendering solute N harmless, and contributes to refinement of a structure. For the purpose of fixing the solute N in particular, it is preferred that Al be contained in an amount of more than two times the N content. However, Al is also an element by which decarburization is accelerated as in the case of Si. In the case of a spring steel containing a large amount of Si, it is therefore necessary to restrain addition of Al in a large amount. In the present invention, the Al content is 0.1% or less, preferably 0.07% or less, still preferably 0.05% or less.

(P: 0.02% or Less (not Including 0%))

P is a harmful element which deteriorates toughness and ductility of the steel material, so that it is important that P is decreased as much as possible. In the present invention, the content thereof is limited to 0.02% or less. It is preferred that the P content is suppressed preferably to 0.010% or less, and more preferably to 0.008% or less. P is an impurity unavoidably contained in the steel material, and it is difficult in industrial production to decrease the amount thereof to 0%.

(S: 0.02% or Less (not Including 0%))

S is a harmful element which deteriorates toughness and ductility of the steel material, as is the case with P described above, so that it is important that S is decreased as much as possible. In the present invention, the S content is suppressed to 0.02% or less, preferably 0.010% or less, and more preferably 0.008% or less. S is an impurity unavoidably contained in the steel, and it is difficult in industrial production to decrease the amount thereof to 0%.

(N: 0.02% or Less (not Including 0%))

N has an effect of forming a nitride to refine the structure, when Al, Ti, or the like is present. However, when N is present in a solute state, N deteriorates toughness, ductility and hydrogen embrittlement resistance properties of the steel material. In the present invention, the N content is limited to 0.02% or less. The N content is preferably 0.010% or less, and more preferably 0.0050% or less.

In the steel material applied in the present invention, the remainder is composed of iron and unavoidable impurities (for example, Sn, As, and the like), but trace components (acceptable components) can be contained therein to such a degree that properties thereof are not impaired. Such a steel material is also included in the range of the present invention.

Further, it is also effective that (a) 0.015% or less (not including 0%) of B, (b) one or more kinds selected from the group consisting of: 1% or less (not including 0%) of V; 0.3% or less (not including 0%) of Ti; and 0.3% or less (not including 0%) of Nb, (c) 3% or less (not including 0%) of Ni and/or 3% or less (not including 0%) of Cu, (d) 2% or less (not including 0%) of Mo, (e) one or more kinds selected from the group consisting of: 0.005% or less (not including 0%) of Ca; 0.005% or less (not including 0%) of Mg; and 0.02% or less (not including 0%) of REM, (f) one or more kinds selected from the group consisting of: 0.1% or less (not including 0%) of Zr; 0.1% or less (not including 0%) of Ta; and 0.1% or less (not including 0%) of Hf, or the like is contained, as needed. Reasons for limiting the ranges when these components are contained are as follows.

(B: 0.015% or Less (not Including 0%))

B has an effect of inhibiting fracture from prior austenite grain boundaries after quenching-tempering of the steel material. In order to exhibit such an effect, it is preferred that B is contained in an amount of 0.001% or more. However, when B is contained in an excessive amount, coarse carboborides are formed to impair the properties of the steel material. Further, when B is contained more than necessary, it contributes to the occurrence of flaws of a rolled material. Accordingly, the B content is limited to 0.015% or less. The B content is more preferably 0.010% or less, and still more preferably 0.0050% or less.

(At Least One Kind Selected from the Group Consisting of V: 1% or Less (not Including 0%), Ti: 0.3% or Less (not Including 0%) and Nb: 0.3% or Less (not Including 0%))

V, Ti and Nb form carbo-nitrides (carbides, nitrides and carbonitrides), sulfides or the like with C, N, S and the like to have an action of rendering these elements harmless. In addition, the carbo-nitride is formed to thereby have an effect of refining austenite structure during heating in the annealing step in the production of a hollow steel pipe and in the quenching process in the production of springs. Further, they also have an effect of improving delayed fracture resistance properties. In order to exhibit these effects, it is preferred that at least one kind of Ti, V and Nb be contained in an amount of 0.02% or more (in an amount of 0.2% or more in total in the case of containing two or more of these). However, when these elements are contained in excess, coarse carbo-nitride may be formed to result in deterioration of toughness or ductility. Thus, in the present invention, V, Ti and Nb contents are preferably 1% or less, 0.3% or less and 0.3% or less, respectively. It is more preferred that the V content is 0.5% or less, the Ti content is 0.1% or less and the Nb content is 0.1% or less. Further, from the viewpoint of cost reduction, it is more preferred that the V content is 0.3% or less, the Ti content is 0.05% or less and the Nb content is 0.05% or less.

(Ni: 3% or Less (not Including 0%) and/or Cu: 3% or Less (not Including 0%))

Ni is an element effective for inhibiting surface layer decarburization or improving corrosion resistance. For Ni, addition thereof is restrained in the case of taking into consideration cost reduction, so that the lower limit thereof is not particularly provided. However, in the case of inhibiting surface layer decarburization or improving corrosion resistance, it is preferred that Ni is contained in an amount of 0.1% or more. However, when the Ni content becomes excessive, the supercooled structure occurs in the rolled material, or residual austenite is present after quenching, resulting in deterioration of the properties of the steel material in some cases. Accordingly, when Ni is contained, the content thereof is 3% or less. From the viewpoint of cost reduction, the Ni content is preferably 2.0% or less, and more preferably 1.0% or less.

Cu is an element effective for inhibiting surface layer decarburization or improving corrosion resistance, as is the case with Ni described above. In order to exhibit such an effect, it is preferred that Cu is contained in an amount of 0.1% or more. However, when the Cu content becomes excessive, the supercooled structure occurs or cracks occur at the time of hot working in some cases. Accordingly, when Cu is contained, the content thereof is 3% or less. From the viewpoint of cost reduction, the Cu content is preferably 2.0% or less, and more preferably 1.0% or less.

(Mo: 2% or Less (not Including 0%))

Mo is an element effective for securing strength and improving toughness after tempering. However, the Mo content becomes excessive, toughness deteriorates. Accordingly, the Mo content is preferably 2% or less. The Mo content is more preferably 0.5% or less.

(At Least One Kind Selected from the Group Consisting of Ca: 0.005% or Less (not Including 0%), Mg: 0.005% or Less (not Including 0%) and REM: 0.02% or Less (not Including 0%))

Each of Ca, Mg and REM (rare-earth elements) forms sulfide, thereby having an effect of improving toughness through the prevention of MnS extension, and can be added in response to required properties. However, when each of them is contained in an amount beyond the foregoing upper limits, the toughness is deteriorated instead. The Ca content is controlled to 0.005% or less, preferably 0.0030% or less, the Mg content is controlled to 0.005% or less, preferably 0.0030% or less, and the REM content is controlled to 0.02% or less, preferably 0.010% or less. In the present invention, REM is intended to include lanthanide elements (15 elements from La to Lu), Sc (scandium) and Y (yttrium).

(At Least One Kind Selected from the Group Consisting of Zr: 0.1% or Less (not Including 0%), Ta: 0.1% or Less (not Including 0%) and Hf: 0.1% or Less (not Including 0%))

These elements combine with N to form nitrides, and have an effect of refining austenite structure during heating in the annealing step in the production of a hollow steel pipe and in the quenching step in the production of springs. However, it is undesirable to incorporate each of these elements in an excess amount exceeding 0.1% because it brings about coarsening of nitride to result in deterioration of fatigue properties. In view of the situation, the content of each element is controlled to 0.1% or less. The preferred content of each element is 0.050% or less, and the still preferred content is 0.025% or less.

EXAMPLES

The present invention will now be explained in more detail by reference to examples. However, the examples mentioned below should not be construed as limiting the present invention in any way, and it goes without saying that, in carrying out the present invention, various changes and modifications can be added to these examples as appropriate within the scope capable of suiting the spirits in the context described above and later. And such changes and modifications are included in the technical scope of the present invention.

Various kinds of molten steels (medium carbon steels) having the chemical component compositions shown in Table 1 described below were each melted by a usual melting method. The molten steels were cooled, followed by bloom rolling to form rectangular cylinder-shaped billets having a cross-sectional shape of 155 mm×155 mm. These billets were formed into round bars having a diameter of 150 mm by hot forging, followed by machine working, thereby preparing billets for extrusion. In Table 1 described below, REM was added in a form of a misch metal containing about 20% of La and about 40% to 50% of Ce. In Table 1 described below, "-" shows that no element was added.

The billets made in the foregoing manner were heated to 1,000° C., followed by performing hot extrusion to thereby prepare an extruded pipe having an outer diameter of 54 mmϕ and an inner diameter of 35 mmϕ (an average cooling rate of 1.5° C./sec until the temperature achieved to 720° C. after extrusion, an average cooling rate of 0.5° C./sec from 720° C. to 600° C., and natural cooling in the air thereafter). Next, cold working (draw benching: discontinuous-type draw bench; rolling: Pilger rolling mill), annealing and pickling (kind of acid solution: 5% hydrochloric acid, pickling condition: 15 minutes) were repeated multiple times. As a result, a hollow seamless steel pipe having an outer diameter of 16 mmϕ and an inner diameter of 8.0 mmϕ was prepared. As to the conditions under which these operations were carried out, the atmosphere during the annealing, the annealing temperature (the highest heating temperature), the annealing time (heating time) and the average cooling rates after the annealing (heating) (cooling rate 1 and cooling rate 2) are shown in Table 2.

The thus obtained hollow seamless steel pipes were each examined for the number density of coarse carbides, structure size (average grain size) and residual austenite content in accordance with the following methods.

(Number Density of Coarse Carbide Particles)

As to the number density of carbides in an inner surface layer part of a steel pipe, a sample for use in observing an arbitrary traverse plane thereof (a cross section orthogonal to the axis of the pipe) was prepared by carrying out cutting, embedding with a resin, mirror polishing, and then etching through the corrosion with picral. A surface layer part ranging from the outermost surface to a depth of 100 μm in the inner peripheral surface was observed by a scanning electron microscope (SEM) (magnification: 3,000 times). On a basis of SEM photographs each (number of observation spots: 3), an area occupied by carbide was determined using an image analysis software (Image-Pro), and converted into a circle equivalent diameter. And the number density of carbide particles having circle equivalent diameters of 500 nm or more was measured at each observation spot, and the average thereof was calculated.

(Structure Size: Average Grain Size)

As to the structure size in an inner surface layer part of a steel pipe, a sample for use in observing an arbitrary traverse plane thereof (a cross section orthogonal to the axis of thel pipe) was prepared by carrying out cutting, embedding with a resin, mirror polishing, and then etching through the corrosion with nital. A surface layer part extending from the inner surface to an inward position of 100 μm was observed by an optical microscope (magnification: 100 to 400 times), and grain sizes were determined by the comparison method, followed by converting into an average grain size by the use of the expression (1) (number of measurement spots: 4).

(Residual Austenite Content)

As to the residual austenite content in an inner surface layer part of a steel pipe, a sample for use in observing an arbitrary traverse plane thereof (a cross section orthogonal to the axis of the pipe) was prepared by carrying out cutting, embedding with a resin, wet polishing, and then electrolytic polishing finish. The residual austenite content (unit: vol. %) in this sample was determined by X-ray diffraction analysis. The case where the residual austenite content was 5% or less was rated as o, while the case where the residual austenite content was more than 5% was rated as x.

(Fatigue Strength Test: Durability)

Each of the foregoing seamless steel pipes was subjected to quenching and tempering under the following conditions which were assumed to be the heat treatment to be applied to hollow springs, followed by working into a JIS test specimen (JIS Z 2274 fatigue test specimen).

(Quenching and Tempering Conditions)

Quenching condition: retention at 925° C. for 10 minutes and subsequent oil cooling Tempering condition: retention at 390° C. for 40 minutes and subsequent water cooling On each of the test specimens mentioned above (quenched and tempered test specimens), rotary bending fatigue test was performed at a rotation speed of 1,000 rpm under a stress of 900 MPa. The case where fracture occurred when the number of repetitions reached or exceeded $1.0\times10^5$ times was rated as o, while the case where fracture occurred before the number of repetitions reached $1.0\times10^5$ times was rated as x. These evaluation results are shown in Table 2 (durability test results).

TABLE 1

| Steel No. | Chemical Composition (mass %), Remainder: Fe and Unavoidable Impurities other than P and S | | | | | | | | | | | | | | | | |
|---|---|---|---|---|---|---|---|---|---|---|---|---|---|---|---|---|---|
| | C | Si | Mn | Cr | Al | P | S | N | B | V | Ti | Nb | Ni | Cu | Mo | Ca, Mg, REM | Zr, Ta, Hf |
| A1 | 0.40 | 2.48 | 1.21 | 1.07 | 0.0315 | 0.004 | 0.006 | 0.0028 | 0.0048 | — | 0.180 | — | 0.41 | 0.15 | — | — | — |
| A2 | 0.41 | 1.72 | 0.17 | 1.01 | 0.0240 | 0.004 | 0.003 | 0.0021 | — | 0.165 | 0.060 | — | 0.31 | 0.17 | — | — | — |
| A3 | 0.43 | 1.90 | 0.21 | 0.95 | 0.0350 | 0.007 | 0.007 | 0.0040 | — | 0.150 | 0.070 | — | 0.60 | 0.31 | — | — | — |
| A4 | 0.44 | 1.60 | 0.45 | 0.48 | 0.0700 | 0.012 | 0.013 | 0.0050 | — | — | 0.050 | 0.040 | — | 0.13 | — | Ca:0.0015 | — |
| A5 | 0.45 | 1.75 | 0.70 | 0.75 | 0.0020 | 0.015 | 0.015 | 0.0030 | — | — | 0.090 | — | 0.15 | 0.10 | — | REM:0.0017 | Zr:0.04 |
| A6 | 0.46 | 1.72 | 0.18 | 0.90 | 0.0250 | 0.006 | 0.006 | 0.0031 | — | 0.500 | — | — | 0.20 | 0.30 | — | — | — |
| A7 | 0.55 | 1.41 | 0.71 | 0.72 | 0.0370 | 0.018 | 0.018 | 0.0049 | — | 0.200 | — | — | — | — | 0.6 | — | — |
| A8 | 0.55 | 1.45 | 0.70 | 0.70 | 0.0280 | 0.015 | 0.015 | 0.0045 | — | — | — | — | — | — | — | — | — |
| A9 | 0.60 | 2.10 | 0.60 | 0.17 | 0.0330 | 0.020 | 0.020 | 0.0040 | — | 0.100 | 0.120 | 0.050 | — | — | — | — | — |
| A10 | 0.60 | 2.00 | 0.75 | 0.15 | 0.0300 | 0.017 | 0.015 | 0.0048 | 0.0050 | — | — | — | — | — | — | — | — |

TABLE 2

| Test No. | Steel No. | Annealing Condition | | | Cooling Condition | | Number | | | |
|---|---|---|---|---|---|---|---|---|---|---|
| | | Atmosphere | Highest heating temperature (° C.) | Heating time <900° C. or more> (min) | Cooling rate 1 <900° to 750° C.> (° C./sec) | Cooling rate 2 <750° to 600° C.> (° C./sec) | Density of Coarse Carbides (particles/μm²) | Structure Size (μm) | Residual Austenite | Durability Test Result 900 MPa |
| 1 | A1 | Ar gas | 920 | 4 | 1.7 | 0.2 | $0.8\times10^{-2}$ | 12 | ○ | ○ |
| 2 | A2 | Ar gas | 920 | 5 | 1.8 | 0.3 | $0.7\times10^{-2}$ | 10 | ○ | ○ |
| 3 | A2 | Ar gas | 920 | 5 | 3.2 | 0.3 | $0.5\times10^{-2}$ | 6 | ○ | ○ |
| 4 | A2 | Ar gas | 920 | 5 | 0.4 | 0.4 | $0.3\times10^{-2}$ | 20 | ○ | x |
| 5 | A2 | Ar gas | 920 | 5 | 3.2 | 3.1 | 0 | 3 | x | x |
| 6 | A2 | Ar gas | 900 | 2 | 2.1 | 0.3 | $0.6\times10^{-2}$ | 6 | ○ | ○ |
| 7 | A2 | Ar gas | 950 | 8 | 1.9 | 0.3 | $0.6\times10^{-2}$ | 8 | ○ | ○ |

TABLE 2-continued

| Test No. | Steel No. | Annealing Condition: Atmosphere | Highest heating temperature (° C.) | Heating time <900° C. or more> (min) | Cooling Condition: Cooling rate 1 <900° to 750° C.> (° C./sec) | Cooling rate 2 <750° to 600° C.> (° C./sec) | Number Density of Coarse Carbides (particles/μm$^2$) | Structure Size (μm) | Residual Austenite | Durability Test Result 900 MPa |
|---|---|---|---|---|---|---|---|---|---|---|
| 8 | A2 | Ar gas | 1,000 | 5 | 1.7 | 0.3 | $0.3 \times 10^{-2}$ | 27 | ○ | x |
| 9 | A3 | Ar gas | 920 | 1 | 0.7 | 0.9 | $1.1 \times 10^{-2}$ | 7 | ○ | ○ |
| 10 | A3 | Ar gas | 920 | 1 | 0.7 | 0.5 | $1.1 \times 10^{-2}$ | 8 | ○ | ○ |
| 11 | A3 | Ar gas | 920 | 5 | 1.7 | 0.4 | $1.1 \times 10^{-2}$ | 11 | ○ | ○ |
| 12 | A3 | Ar gas | 920 | 20 | 1.8 | 0.4 | $0.5 \times 10^{-2}$ | 19 | ○ | x |
| 13 | A3 | Ar gas | 920 | 60 | 1.8 | 0.4 | $0.3 \times 10^{-2}$ | 21 | ○ | x |
| 14 | A3 | Ar gas | 905 | 2 | 2.2 | 0.4 | $0.4 \times 10^{-2}$ | 5 | ○ | ○ |
| 15 | A3 | Ar gas | 950 | 9 | 1.5 | 0.4 | $0.1 \times 10^{-2}$ | 15 | ○ | ○ |
| 16 | A3 | Ar gas | 1,000 | 5 | 1.6 | 0.4 | $0.1 \times 10^{-2}$ | 25 | ○ | x |
| 17 | A4 | Ar gas | 920 | 5 | 1.4 | 0.4 | $1.8 \times 10^{-2}$ | 17 | ○ | ○ |
| 18 | A4 | Air | 680 | 60 *1 | — | 0.3 | $2.8 \times 10^{-2}$ | 8 | ○ | x |
| 19 | A4 | Air | 750 | 60 *1 | — | 0.3 | $4.2 \times 10^{-2}$ | 9 | ○ | x |
| 20 | A5 | Ar gas | 920 | 5 | 1.4 | 0.4 | $0.3 \times 10^{-2}$ | 13 | ○ | ○ |
| 21 | A6 | Ar gas | 920 | 3 | 1.3 | 0.3 | $0.6 \times 10^{-2}$ | 16 | ○ | ○ |
| 22 | A7 | Ar gas | 920 | 3 | 1.5 | 0.3 | $0.7 \times 10^{-2}$ | 15 | ○ | ○ |
| 23 | A7 | Ar gas | 920 | 3 | 1.8 | 1.5 | $0.7 \times 10^{-2}$ | 5 | x | x |
| 24 | A8 | Ar gas | 930 | 1 | 1.2 | 0.3 | $0.2 \times 10^{-2}$ | 15 | ○ | ○ |
| 25 | A9 | Ar gas | 920 | 3 | 1.9 | 0.4 | 0 | 8 | ○ | ○ |
| 26 | A10 | Ar gas | 930 | 1 | 1.5 | 0.3 | $0.2 \times 10^{-2}$ | 13 | ○ | ○ |

*1: Heating time (staying time) in each of No. 18 and No. 19 was under temperatures of 650° C. or more.

As can be seen from these results, the hollow seamless steel pipes produced from steel materials having appropriate chemical compositions under appropriate conditions (Test. Nos. 1 to 3, 6, 7, 9 to 11, 14, 15, 17, 20 to 22 and 24 to 26) were good in fatigue strength of the springs made therewith.

On the other hand, it can be seen that deterioration in fatigue strength occurred in Test Nos. 4, 5, 8, 12, 13, 16, 18, 19 and 23 because the production processes were inappropriate, and hence the requirements specified by the present invention were not satisfied.

More specifically, the Test No. 4 is an example that the cooling rate 1 was slow, and thus, the average grain size (structure size) of the ferrite-pearlite structure was large, namely coarse, resulting in decrease of fatigue strength (durability).

The Test Nos. 5 and 23 are examples that the cooling rate 2 was too fast, and thus, the residual austenite content was large, resulting in decrease of fatigue strength (durability).

The Test Nos. 8 and 16 are examples that the highest heating temperature during the annealing was high, and thus, the average grain size (structure size) of the ferrite-pearlite structure was large, resulting in decrease of the fatigue strength (durability).

The Test Nos. 12 and 13 are examples that the heating time at a temperature of 900° C. or more was too long, and thus, the fatigue strength (durability) was decreased.

The Test Nos. 18 and 19 are examples that the annealing was carried out in the air at low temperatures. In these examples, the number density of coarse carbides was large and the fatigue strength (durability) was decreased.

The present patent application has been illustrated above in detail or by reference to the specified embodiments. It will, however, be apparent to persons skilled in the art that various changes and modifications can be made without departing from the spirit and scope of the present invention.

This application is based on Japanese Patent Application No. 2012-132104, filed on Jun. 11, 2012, the contents of which are incorporated herein by reference.

INDUSTRIAL APPLICABILITY

In producing the present seamless steel pipe for a hollow spring, not only the chemical composition of a steel material as raw material was appropriately adjusted, but also various structures (residual austenite, an average grain size of a ferrite-pearlite structure, and coarse carbides) in an inner surface layer part of the steel pipe are controlled appropriately. Thus, springs made from the seamless steel pipe for a hollow spring are able to secure sufficient fatigue strength.

The invention claimed is:

1. A seamless steel pipe for a hollow spring, comprising iron, 0.2 mass % to 0.7 mass % of C, 0.5 mass % to 3 mass % of Si, 0.1 mass % to 2 mass % of Mn, more than 0 mass % and 3 mass % or less of Cr, more than 0 mass % and 0.1 mass % or less of Al, more than 0 mass % and 0.02 mass % or less of P, more than 0 mass % and 0.02 mass % or less of S and more than 0 mass % and 0.02 mass % or less of N, wherein a residual austenite content in an inner surface layer part of the steel pipe is 5 vol. % or less, an average grain size of a ferrite-pearlite structure in the inner surface layer part of the steel pipe is 18 μm or less and a number density of a carbide which has a circle equivalent diameter of 500 nm or more and is present in the inner surface layer part of the steel pipe is $1.8 \times 10^{-2}$ particles/μm$^2$ or less.

2. The seamless steel pipe for a hollow spring according to claim 1, further comprising more than 0 mass % and 0.015 mass % or less of B.

3. The seamless steel pipe for a hollow spring according to claim 2, further comprising at least one selected from the group consisting of more than 0 mass % and 1 mass % or less of V, more than 0 mass % and 0.3 mass % or less of Ti and more than 0 mass % and 0.3 mass % or less of Nb.

4. The seamless steel pipe for a hollow spring according to claim 3, further comprising at least one selected from the group consisting of more than 0 mass % and 3 mass % or less of Ni and more than 0 mass % and 3 mass % or less of Cu.

5. The seamless steel pipe for a hollow spring according to claim 1, further comprising at least one selected from the group consisting of more than 0 mass % and 1 mass % or less of V, more than 0 mass % and 0.3 mass % or less of Ti and more than 0 mass % and 0.3 mass % or less of Nb.

6. The seamless steel pipe for a hollow spring according to claim 5, further comprising at least one selected from the group consisting of more than 0 mass % and 3 mass % or less of Ni and more than 0 mass % and 3 mass % or less of Cu.

7. The seamless steel pipe for a hollow spring according to claim 1, further comprising more than 0 mass % and 2 mass % or less of Mo.

8. The seamless steel pipe for a hollow spring according to claim 1, further comprising at least one selected from the group consisting of more than 0 mass % and 0.005 mass % or less of Ca, more than 0 mass % and 0.005 mass % or less of Mg and more than 0 mass % and 0.02 mass % or less of REM.

9. The seamless steel pipe for a hollow spring according to claim 1, further comprising at least one selected from the group consisting of more than 0 mass % and 0.1 mass % or less of Zr, more than 0 mass % and 0.1 mass % or less of Ta and more than 0 mass % and 0.1 mass % or less of Hf.

* * * * *